United States Patent [19]

Ulricksen

[11] 4,052,136

[45] Oct. 4, 1977

[54] MARINE STOVE SAFETY CONTROLS

[76] Inventor: Ralph L. Ulricksen, Box 418, Sitka, Alaska 99835

[21] Appl. No.: 669,023

[22] Filed: Mar. 22, 1976

[51] Int. Cl.[2] ..... F23N 5/00; G05D 23/00

[52] U.S. Cl. ..... 431/77; 236/1 H; 236/1 A; 137/457

[58] Field of Search ..... 431/23, 75, 77, 78, 431/80, 83, 84, 69; 236/1 G, 1 A, 1 H; 137/457, 468; 337/337-340, 353, 335, 356, 357-359; 251/68, 69

[56] References Cited

U.S. PATENT DOCUMENTS

| | | | |
|---|---|---|---|
| 1,973,253 | 9/1934 | Henning | 337/340 |
| 2,169,696 | 8/1939 | Hotchkiss | 251/69 X |
| 2,295,455 | 9/1942 | Dillman | 237/2 R X |
| 2,652,065 | 9/1953 | Kutzler | 251/69 X |
| 2,910,079 | 10/1959 | Beeghly | 251/68 X |
| 3,024,835 | 3/1962 | Ryder | 431/69 X |

*Primary Examiner*—Edward G. Favors
*Assistant Examiner*—Larry Jones
*Attorney, Agent, or Firm*—Bacon & Thomas

[57] ABSTRACT

A thermostat is arranged to be responsive to the temperature of flue gases from an oil burning heater and actuates switches when the temperature of the flue gases reaches either a predetermined high value or a predetermined low value. The switches are effective, when actuated by the thermostat, to cut off flow of oil to the burner, either by stopping operation of a pump or by effecting closing of a valve in the oil supply conduit. The thermostat is provided with a latch that holds it in the high temperature position, when that position has been reached so that cooling of the flue gases thereafter will not result in resumption of oil flow to the heater. In one form of the invention the same circuit arrangement can be adapted to control either a pump-fed heater or a gravity-fed heater.

1 Claim, 5 Drawing Figures

MARINE STOVE SAFETY CONTROLS

BACKGROUND OF THE INVENTION

This invention is in the field of safety devices for oil burning heaters to prevent overheating or loss of oil when inoperative.

Due to a predominance of cold and wet weather, many owners of both commercial and pleasure marine vessels in many regions prefer oilstoves to other types of heat. LP gas and gasoline stoves are hazardous due to their flammability and explosive nature. Alcohol stoves generate moisture. Electric heat is prohibitive unless used only while moored to a source of commercial power or if boat is equipped with high voltage power generation. All are inferior to oil heat's steady, less costly, high BTU generation and its ability to be left on for extended periods, keeping moisture and mildew in the cabin at a minimum. Thus, many owners will remove a commercially installed heater and replace it with an oil stove.

Leaving an oilstove unattended, however, has been a disaster to many boat owners. Flooded stoves have burned up many vessels and many a battery has been discharged and the oil pump burned out when the oil storage tank has run dry.

Marine stove installations are basically either gravity fed from a tank above the heater or pump fed from a tank level with or below the oil heater. There are also two basic systems for feeding oil to the burner, the drip valve type that is manually operated but which is hard to adjust since the viscosity of the oil decreases as the heater warms up and thus dangerously increases flow to the burner pot. The other type comprises a carburetor having float valves which are provided in an effort to provide a safety feature preventing flooding but such devices have no shut-off means in the event of excessively high temperatures.

Installations heretofore have included various combinations of the above metering systems. None are acceptable to be left unattended. For positive excessive high heat and/or low heat protection, a heat operated safety control to interrupt the oil supply is most desirable. The necessity for excessive high heat protection goes without comment, but protection against too low or no heat bears some explanation:

1. Wind or other draft conditions often times blow out a flame left on low, thus oil continues to flow into a hot stove pot, vaporizes and could be reignited by a "hot spot" or other source.

2. A charge of water in the fuel line could put out the flame, and continue to flow oil into the pot. The least problem that results is that the contents of the oil storage tank will be emptied into the boat cabin.

3. A pump is pressure operated, i.e., if oil in tank runs out, pump "runs wild" trying to bring up the pressure, thus burning itself out and possibly causing an electrical fire or at least completely discharging the vessel's battery.

4. Carburetor floats sometimes jam open when dirty or faulty, flooding the stove. The heat operated switch provides a back-up safety control.

It has been recognized that some safety defices for burners are desirable and a number of proposals have been made for safety devices for gas burners, gasoline burners and the like. For example, see U.S. Pat. Nos. 372,207, 2,381,591, 2,388,855 and 2,482,565. These patents, however, do not disclose devices suitable for use with an oil burning heater on a marine vessel.

SUMMARY OF THE INVENTION

The present invention is an electrically operated safety system to be attached to an oil stove which will shut it off if operating heat exceeds either of two predetermined but adjustable high and low temperature levels, thus rendering the stove safe for unattended use. This system is compatible with the boat's electrical supply and may be used even while under way or moored away from external power.

A bimetal heat sensing element which operates a switch is installed in or strapped to the stove pipe and positively feels variations in heat being transmitted up the chimney. The switch controls an electrically operated plunger valve in the oil feed line as close to the stove pot as possible, although satisfactory control may be obtained anywhere along the oil line.

Since the boat's electrical supply is usually low voltage direct current dependable upon recharging by engine generator, an electrically operated valve which does not draw a significant amount of current is desirable. A valve, which when energized will simultaneously shut off the energy feeding it, is shown in the attached drawing. Due to the "pulse" type operation of this valve, using a coil of lower operating voltage than the boat's electrical system, a low battery condition will not deter its operation. The momentary pulse of 12 volts, for instance, on a 6 volt coil will not harm the coil, but will give low battery capability. Units can be built for use with the common marine voltages.

An alternate shut off for use with a pump fed system and carburetor feed combination is provided but is not as instantaneous as the valve operated type due to drain time of the carburetor, but prototype tests show it to be satisfactory. The auto pulse-drip feed combination hs a quicker shut off, as do all other gravity fed combinations provided the valve is installed close to the burner.

It is, therefore, an object of this invention to provide a safety control device for oil burning heaters including a thermostat responsive to temperatures resulting from operation of the burner to shut off the oil supply when the temperature reaches too high a value and to shut off the oil supply in the evemt the flame is extinguished.

A further object is to provide a device as set forth including means for preventing resumption of oil flow upon reduction of heater temperature and requiring manual manipulation to restore oil flow.

DESCRIPTION OF THE PREFERRED EMBODIMENTS

Figure 1:
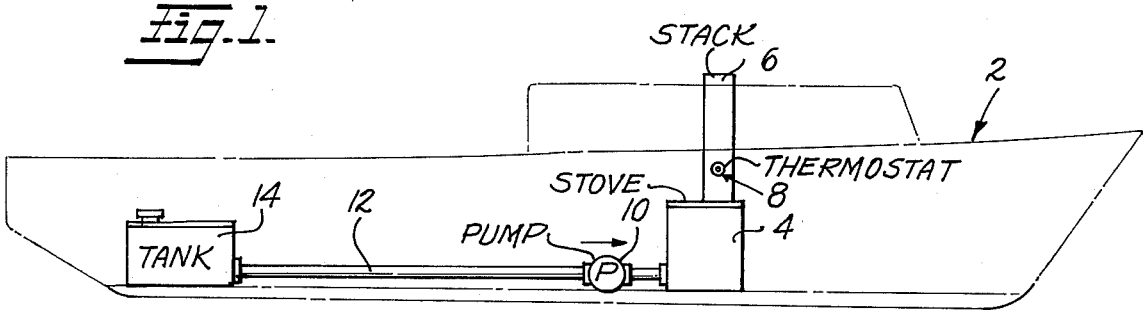
FIG. 1 is a schematic view of a marine vessel showing the relationship of basic elements.

In FIG. 1, numeral 2 designates generally a marine vessel having an oil burning heater 4 therein. The products of combustion are exhausted through a stack 6 on or in which a thermostat 8 is provided, to be referred to later. The heater 4 is provided with oil by a pump 10 in conduit 12 leading from supply tank 14. This figure merely illustrates one contemplated type of installation.

Figure 2:
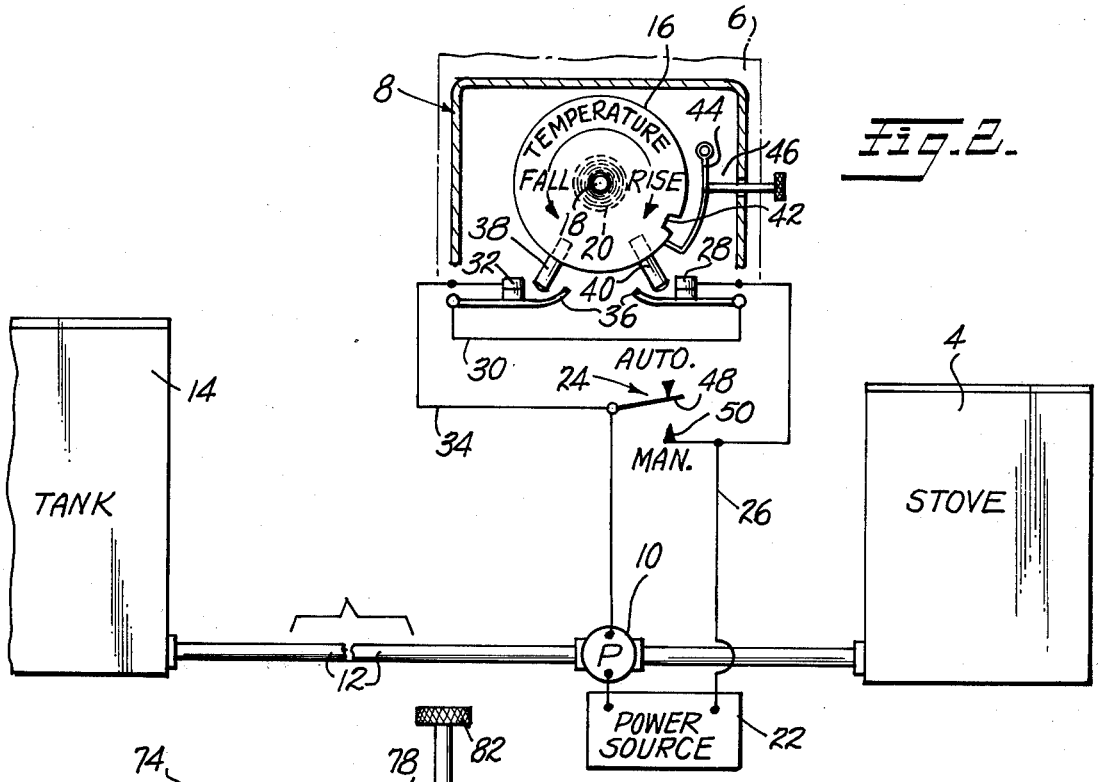
FIG. 2 is a wiring diagram of a safety device for use with an oil burner having a pump feed.

In FIG. 2, the thermostat 8 is shown in greater detail and comprises a rotary member 16 mounted for rotation about an axis 18. A bimetallic spiral spring member 20 of known construction is arranged to respond to the temperature of gases in stack 6 and to effect rotation of member 16 to a position indicative of that temperature.

An electric power source 22 of any suitable type is provided to supply power to the pump 10. The circuit includes a manual switch 24 shown in its "automatic" position. Under the conditions shown, a circuit is completed from the power source through the pump 10 by way of circuit conductor 26, normally closed switch 28, conductor 30, normally closed switch 32, and conductor 34.

The switches 28 and 32 have operating fingers 36 arranged in the path of movement of pins 38 and 40 on rotary member 16. If the temperature of the gases in the stack 6 rise to too high a value, the member 16 rotates clockwise far enough for its pin 40 to open switch 28, thus opening the circuit feeding electrical energy to pump 10. The pump then stops and discontinues feeding oil to the stove. Preferably, the member 16 is also provided with a notch 42 and the thermostat is provided with a spring urged pivoted arm 44 having an inwardly bent nose portion adapted to enter the slot 42 when the temperature reaches a predetermined high value. The arm 44 is thus projected into notch 42 and retained therein by spring 46 in a position to lock the member 16 against counterclockwise rotation upon cooling of the gases in stack 6 and the pump 10 will not resume operation until the stove is again relit and the arm 44 is manually released from notch 42. If the flame in stove 4 is extinguished, the flue gases will cool and cause member 16 to rotate counterclockwise until pin 38 opens the other switch 32 and the pump is stopped.

The switch 24 may be manually actuacted to place its blade 48 in contact with terminal 50 and thus directly complete a circuit from the power source through the pump. In this mode of operation, the safety feature described is inoperative. While a pair of switches, 28 and 32, are shown, it is to be understood that a single switch could be devised to be opened by either pin 38 or 40 upon the temperature reaching the predetermined limits. Furthermore, it is also contemplated that the pins 38 and 40 may be mounted for adjustment around the member 16 to whatever predetermined maximum and minimum temperature positions are desired.

Figure 3:
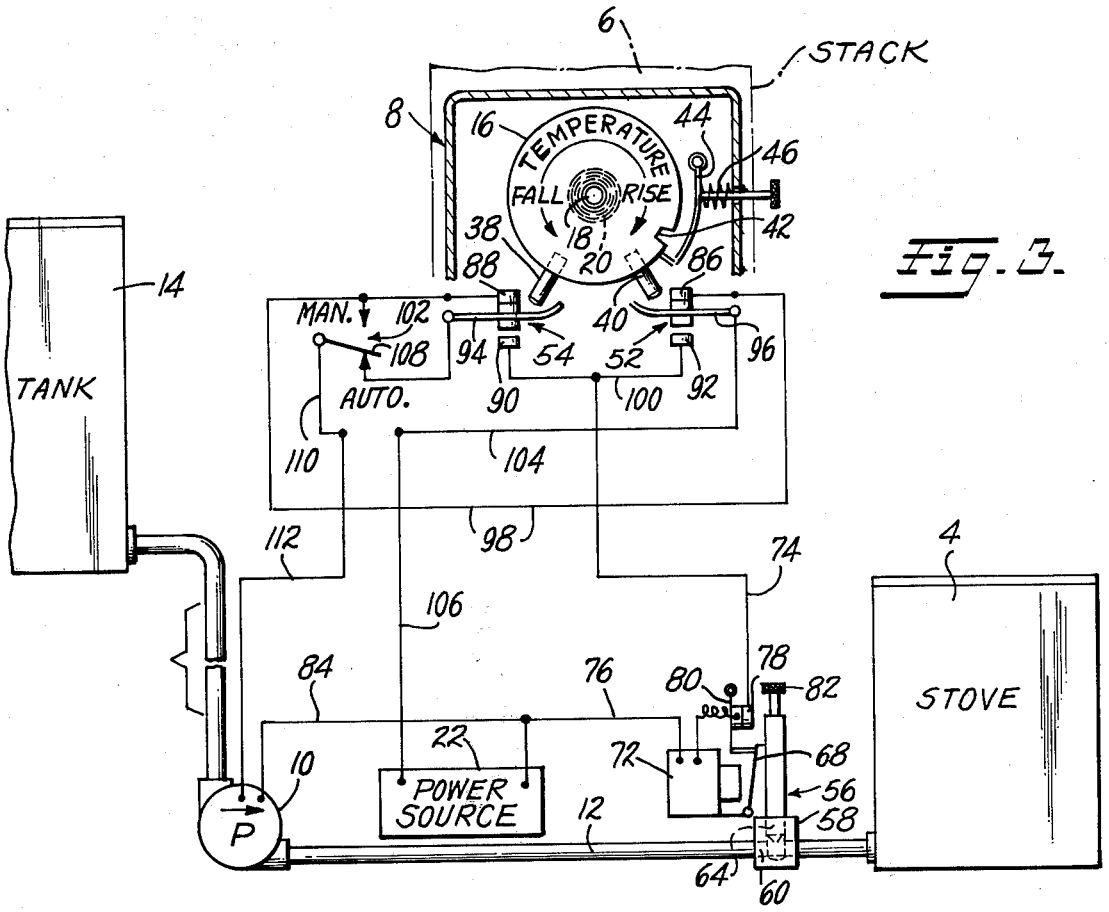
FIG. 3 is a wiring diagram of a circuit adaptable for either pump or gravity fed burners but showing the circuit adapted for the pump feed system.
Figure 4:
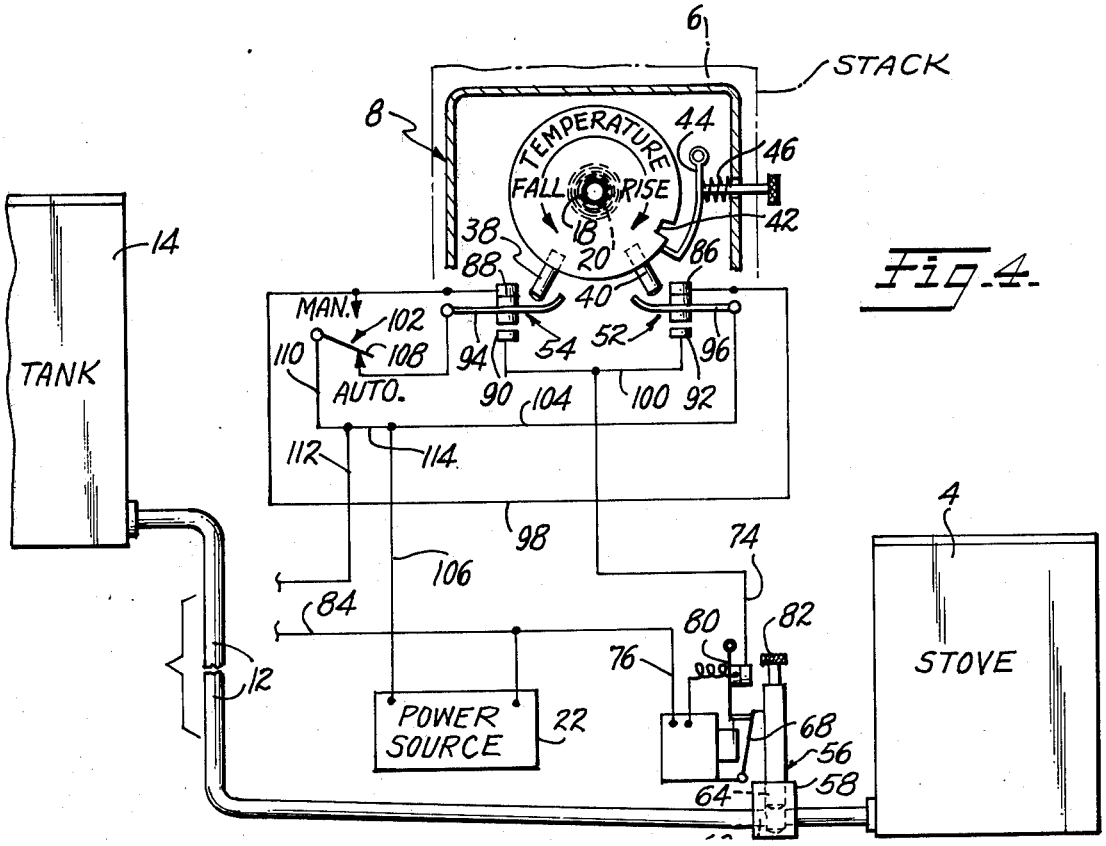
FIG. 4 shows the device of FIG. 3 adapted to control oil flow in a gravity feed system.

The form of the invention shown in FIGS. 3 and 4 is similar to that of FIG. 2 but is adaptable to either a pump fed burner or a gravity fed burner, as will be described. In FIGS. 3 and 4, the thermostat 8 may be identical with that already described with reference to FIG. 2 but instead of the normally closed switches 28 and 32 of FIG. 2, this circuit is provided with double-throw switches 52 and 54. This form of the invention also contemplates a spring biased shut-off valve 56 in conduit 12.

Figure 5:
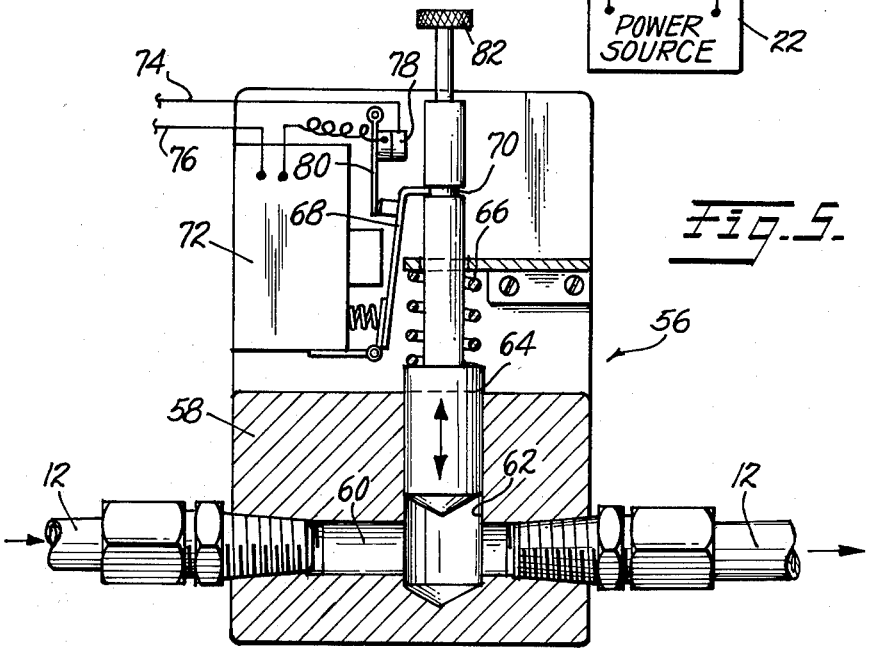
FIG. 5 is a sectional view of a suitable shut-off valve contemplated.

Such a valve is shown by way of example in FIG. 5 and includes a body 58 having a bore 60 providing a portion of the conduit 12 and a cross bore 62 in which a valve member 64 reciprocates. A spring 66 urges valve member 64 to closed position but the valve is held in open position by a spring urged arm 68 having a nose portion engaging a groove 70 in valve 64. A solenoid 72 is arranged to withdraw arm 68 from notch or groove 70 when the solenoid is energized. The solenoid is energized by conductors 74 and 76 which will be referred to later. In series with the solenoid 72 is a normally closed switch 78 having an arm 80 engageable by the arm 68. When solenoid 72 is energized to withdraw arm 68 from groove 70, and thus permit closing of valve 64, it also opens switch 78 to immediately deenergize solenoid 72 to avoid any further drain of electrical energy from the power source. When the solenoid is thus deenergized the spring-pressed arm 68 again swings toward valve 64 but will engage the stem of the valve above groove 70. A manually operable knob 82 is provided on the valve stem whereby the valve 64 may be manually moved to its open position when desired and permit the arm 68 to again enter groove 70 to hold the valve open.

The conductor 76 from valve 56 is connected to one side of the power source 22 which in turn is connected, through conductor 84, to a terminal of the pump 10. The double throw switches 52 and 54 previously referred to include upper fixed contacts 86 and 88 and lower fixed contacts 90 and 92. Arms 94 and 96, corresponding to the arms 36 of FIG. 2, carry contact members thereon engageable with either the upper or lower contacts of each switch. The arms 94 and 96 are biased upwardly to normally engage the upper contacts 86 and 88, as shown. The upper contacts 86 and 88 are mutually connected by a conductor 98 and lower contacts 90 and 92 are mutually connected by conductor 100 to which conductor 74 is also connected. The intermediate contacts on arm 94 are connected to one terminal of the manual switch 102 shown in position for automatic operation. The intermediate contacts on arm 96 are connected through conductors 104 and 106 to the power supply and the central blade 108 of switch 102 is connected through conductors 110 and 112 to the other terminal of pump 10. It is to be noted that the juncture of conductors 110 and 112 is electrically separated from the juncture between conductors 104 and 106.

The parts are shown in FIG. 3 in the position they occup-when the stove is operating. If the temperature in stack 6 reaches either the predetermined upper or lower values referred to, one or the other of the switches 52 and 54 will be actuated to open contact between its intermediate arm and upper contact and to establish contact with the lower contact member of that switch. As will be obvious, under those conditons, the circuit to the pump 10 will be opened and a momentary pulse of current will be fed through solenoid 72 to effect closing of the valve 56 and stopping of pump 10. The arm 44 operates as already described if oil feed was stopped because of high temperature and the stove cannot be restarted without manually withdrawing arm 44 from notch 42 and manually reopening valve 56.

In FIG. 4, the same basic circuit as shown in FIG. 3 is employed to control a gravity fed heater system. When adapted to control such a gravity fed system, conductors 84 and 112 which supply current to the pump 10 in FIG. 3 are shown as disconnected from any load and those conductors may in fact be completely removed. A shunt conductor 114 is connected from the junction between conductors 110 and 112 to the junction between conductors 104 and 106 to effect a complete circuit through the arms 94 and 96 of switches 54 and 52, respectively. It will be obvious to those skilled in the art how the circuit adapted to the gravity fed system will operate to effect complete shutdown of the stove burner upon attaining either an excessively high temperature or when the temperature drops below a predetermined minimum value.

While a limited number of specific embodiments of the invention have been shown and described, the same are merely illustrative of the principles involved and other forms may be resorted to within the scope of the appended claims.

I claim:

1. In a safety control system for an oil burning heater having an oil supply conduit and control means therein for controlling flow of oil therethrough, the improvement comprising:

electrically operated means for actuating said control means;

temperature responsive thermostatic means positioned to sense a temperature that is indicative of the heat produced by said heater, said thermostatic means including a movable member;

means responsive to movement of said member to actuate said electrical means to stop flow of oil in said conduit when the sensed temperature reaches a predetermined low temperature or a predetermined high temperature;

manually releasable means engageable with said movable member to lock it in its position at said predetermined high temperature;

said member being mounted for rotation about an axis with pin means extending radially therefrom; said means responsive to movement of said member being switch means arranged in the path of movement of said pin means; and said member being provided with a peripheral notch, said manually releasable means comprising a movable arm adjacent said member and having a portion projectable into said notch when said member is in said high temperature position, means biasing said arm toward said member, and means for manually retracting said arm from said notch.

* * * * *